US010482760B2

(12) United States Patent
Goepner

(10) Patent No.: US 10,482,760 B2
(45) Date of Patent: Nov. 19, 2019

(54) METHOD FOR LINKING A SECOND REMOTE CONTROL UNIT TO A FIRST REMOTE CONTROL UNIT

(71) Applicant: Jungheinrich Aktiengesellschaft, Hamburg (DE)

(72) Inventor: Oliver Goepner, Oering (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 0 days.

(21) Appl. No.: 16/205,557

(22) Filed: Nov. 30, 2018

(65) Prior Publication Data

US 2019/0172340 A1 Jun. 6, 2019

(30) Foreign Application Priority Data

Dec. 1, 2017 (DE) ..... 10 2017 128 623

(51) Int. Cl.
*G08C 17/02* (2006.01)

(52) U.S. Cl.
CPC ..... *G08C 17/02* (2013.01); *G08C 2201/10* (2013.01); *G08C 2201/20* (2013.01); *G08C 2201/21* (2013.01); *G08C 2201/40* (2013.01)

(58) Field of Classification Search
None
See application file for complete search history.

(56) References Cited

U.S. PATENT DOCUMENTS 3,575,305 A 4/1971 Burch
3,670,905 A 6/1972 Burch
3,746,189 A 7/1973 Burch
3,814,026 A 6/1974 Maloney
3,826,349 A 7/1974 Stevenson, III
3,984,019 A 10/1976 Brudi
(Continued)

FOREIGN PATENT DOCUMENTS

DE 10028023 A1 12/2001
DE 102007054836 A1 5/2009
(Continued)

OTHER PUBLICATIONS

EP 17187252.6; Aug. 22, 2017; European Search Report dated Jan. 31, 2018; 9 pages.
(Continued)

*Primary Examiner* — Daniell L Negron
(74) *Attorney, Agent, or Firm* — Barclay Damon LLP

(57) ABSTRACT

A method for linking a second remote control unit of an industrial truck to a first remote control unit of the industrial truck comprises linking the first remote control unit to a transceiver unit using a bidirectional radio connection. The unique address of the second remote control unit is transmitted to the transceiver unit by near field communication. The unique address of the second remote control unit is transmitted by the transceiver unit to the first remote control unit via the bidirectional radio connection. The first remote control unit is linked to the second remote control unit using the unique address of the second remote control unit. A command is transmitted from the second remote control unit to the first remote control unit and the first remote control unit transmits the command by radio to the transceiver unit.

9 Claims, 1 Drawing Sheet

(56) References Cited

U.S. PATENT DOCUMENTS

| | | | | |
|---|---|---|---|---|
| 4,543,031 | A | 9/1985 | Luebrecht | |
| 5,370,492 | A | 12/1994 | Gleyze | |
| 5,938,710 | A | 8/1999 | Lanza | |
| 8,072,309 | B2 | 12/2011 | Kraimer et al. | |
| 8,193,903 | B2 | 6/2012 | Kraimer et al. | |
| 8,239,251 | B2 | 8/2012 | Wellman | |
| 8,249,910 | B2 | 8/2012 | Wellman et al. | |
| 8,452,464 | B2 | 5/2013 | Castaneda et al. | |
| 8,725,317 | B2 | 5/2014 | Elston et al. | |
| 8,725,362 | B2 | 5/2014 | Elston et al. | |
| 8,725,363 | B2 | 5/2014 | Elston et al. | |
| 8,731,777 | B2 | 5/2014 | Castaneda et al. | |
| 8,963,704 | B2 | 2/2015 | Adami | |
| 8,970,363 | B2 | 3/2015 | Kraimer et al. | |
| 9,002,581 | B2 | 4/2015 | Castaneda et al. | |
| 9,082,293 | B2 | 7/2015 | Wellman et al. | |
| 9,122,276 | B2 | 9/2015 | Kraimer et al. | |
| 9,152,933 | B2 | 10/2015 | Wellman | |
| 9,202,186 | B2 | 12/2015 | Wellman et al. | |
| 9,207,673 | B2 | 12/2015 | Pulskamp et al. | |
| 9,493,184 | B2 | 11/2016 | Castaneda et al. | |
| 9,522,817 | B2 | 12/2016 | Castaneda et al. | |
| 9,645,968 | B2 | 5/2017 | Elston et al. | |
| 9,908,527 | B2 | 3/2018 | Elston et al. | |
| 2003/0044047 | A1 | 3/2003 | Kelly et al. | |
| 2009/0198371 | A1 | 8/2009 | Emanuel | |
| 2009/0281676 | A1* | 11/2009 | Beavis | G06F 1/266 700/295 |
| 2011/0166721 | A1 | 7/2011 | Castaneda | |
| 2012/0078471 | A1 | 3/2012 | Siefring | |
| 2012/0245765 | A1 | 9/2012 | Medwin et al. | |
| 2013/0234827 | A1 | 9/2013 | Tomita et al. | |
| 2014/0042873 | A1 | 2/2014 | Shen et al. | |
| 2014/0195121 | A1 | 7/2014 | Castaneda | |
| 2015/0057843 | A1 | 2/2015 | Kraimer et al. | |
| 2017/0057798 | A1 | 3/2017 | Dues et al. | |
| 2017/0249792 | A1 | 8/2017 | Gennermann | |
| 2018/0057331 | A1 | 3/2018 | Goepner et al. | |
| 2018/0060764 | A1 | 3/2018 | Hance | |
| 2018/0068255 | A1 | 3/2018 | Hance | |
| 2018/0079633 | A1 | 3/2018 | Kraimer et al. | |
| 2018/0157263 | A1 | 6/2018 | Goepner | |

FOREIGN PATENT DOCUMENTS

| | | | |
|---|---|---|---|
| DE | 102012016783 | A1 | 3/2013 |
| DE | 102012018427 | A1 | 5/2014 |
| DE | 102013110456 | A1 | 3/2015 |
| DE | 102016102638 | A1 | 8/2017 |
| EP | 2392538 | A2 | 12/2011 |
| EP | 2468678 | B1 | 11/2015 |
| EP | 2851331 | B1 | 2/2016 |
| EP | 3162754 | A1 | 5/2017 |

OTHER PUBLICATIONS

EP 17205166.6; Dec. 4, 2017; European Search Report dated Apr. 16, 2018; 3 pages.

EP 17205166.6; Dec. 4, 2017 2017; European Search Report dated Apr. 16, 2018 (3 pages).

EP 18207744.6; Nov. 22, 2018; European Search Report dated May 6, 2019; 7 pages.

* cited by examiner

METHOD FOR LINKING A SECOND REMOTE CONTROL UNIT TO A FIRST REMOTE CONTROL UNIT

CROSS REFERENCE TO RELATED INVENTION

This application is based upon and claims priority to, under relevant sections of 35 U.S.C. § 119, German Patent Application No. 10 2017 128 623.3, filed Dec. 1, 2017, the entire contents of which are hereby incorporated by reference.

BACKGROUND

The method is preferably used in conjunction with industrial trucks where particularly high demands are placed on the availability of the remote control units.

In controlling industrial trucks remotely, a 1:1 connection is provided between the remote control unit and the industrial truck. This unambiguousness ensures that only one single remote control unit can issue commands remotely to just one industrial truck. In this context, it is conventional to use battery-operated control units for the remote control units that must be charged to use the industrial truck. It can be technically involved to change the assignment of the remote control units to a transceiver unit of an industrial truck.

The object of the invention is to provide a method that can be easily and flexibly used to link a second remote control.

BRIEF SUMMARY OF THE INVENTION

In an embodiment, a method according to the invention comprises linking a second remote control unit to a first remote control unit. In this case, the first remote control unit is configured for a radio connection with a transceiver unit as for example can be provided in an industrial truck. The method according to the invention provides a link of the first remote control unit to the transceiver unit for a radio connection. After linking the first remote control unit, signals, data, and information can be exchanged between the first remote control unit and the transceiver unit by radio. In an additional method step, a unique address of the second remote control unit is transmitted to the transceiver unit via near field communication. With the assistance of the unique address of the second remote control unit, all of the information on the two remote control units are present in the transceiver unit. In another step, the transceiver unit sends the unique address of the second remote control unit to the first remote control unit. The first remote control unit is then linked to the second remote control unit by the sent unique address of the second remote control unit. The second remote control unit therefore transmits its unique address to the transceiver unit, which sends the unique address of the second remote control unit to the first remote control unit so that the first remote control unit is linked to the second remote control unit. Corresponding to this link between the first and second remote control unit, a command is sent by the second remote control unit to the transceiver unit of the industrial truck, wherein the command is sent by the second remote control unit to the first remote control unit that forwards the command by radio to the transceiver unit.

The particular advantage of the method according to the invention consists of the 1:1 connection remaining between the industrial truck, and its transceiver unit, with the first remote control unit. The second remote control unit is linked by the first remote control unit to the transceiver unit of the industrial truck.

In an embodiment, the first remote control unit is supplied by a battery or accumulator. The first remote control unit can be supplied for the intended operation by means of its own energy supply.

In another embodiment, the second remote control unit is equipped with a control element that generates sufficient power for sending the command when it is actuated. Due to its design as an energy store without a battery or an accumulator, the second remote control unit is not configured to continuously maintain a radio connection with the transceiver unit in the industrial truck. The power needed for sending a signal or a command from the second remote control unit to the first remote control unit is generated by actuating the control element.

In an embodiment, the first and second remote control unit each have a module for near field communication with the transceiver unit. The module for near field communication can be configured to be active with its own power supply, or passive. In a passive configuration, the energy of the transceiver unit is transmitted to the module for near field communication.

In an embodiment, the first remote control unit can be linked to the transceiver unit by means of near field communication, wherein the first remote control unit sends its unique address to the transceiver unit. According to another embodiment, the transceiver unit can assign the two unique addresses of the radio remote control units to each other for permitting the signals to be forwarded from the first remote control unit to the second remote control unit, wherein the unique address of the second remote control unit is sent to the first remote control unit for this.

In an embodiment, the first remote control unit disconnects the link to the second remote control unit when the first remote control unit did not have a radio connection with the transceiver unit for a predetermined duration, or the transceiver unit has been turned off. The first remote control unit deletes the unique address of the second remote control unit in its memory so that communication is no longer possible in which commands are forwarded from the second remote control unit via the first remote control unit to the transceiver unit of the industrial truck.

BRIEF DESCRIPTION OF THE DRAWINGS

The present invention is explained in the following in more detail using an exemplary embodiment. In the following.

DETAILED DESCRIPTION OF THE INVENTION

Figure 1:
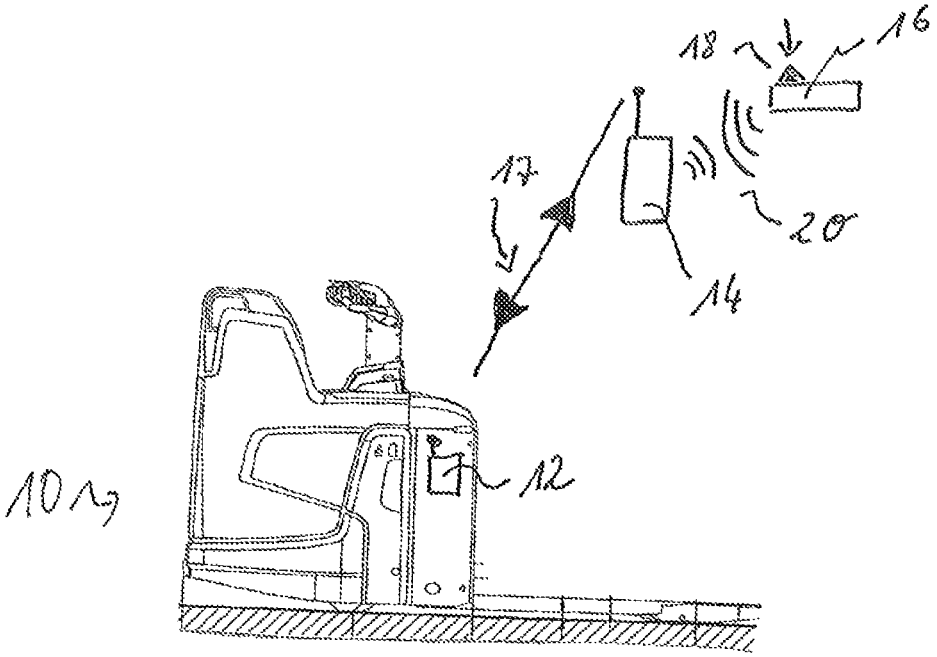
FIG. 1 illustrates an embodiment of an industrial truck with a first and a second remote control unit.

FIG. 1 shows an industrial truck 10 that is configured as a tagalong pedestrian controlled pallet truck. The industrial truck 10 includes a transceiver unit 12 that on the one hand is configured to communicate by radio across distances of a few meters, and on the other hand is configured to read out a unique address with the assistance of near field communication. The transceiver unit 12 is also configured to record and save at least two unique addresses and assign them to each other. The unique addresses are for example so-called MAC addresses, wherein MAC stands for media access control and specifies unique identification for a device in a network.

A first remote control unit 14 is provided. During operation, the first remote control unit 14 sends and receives signals and commands by radio 17 from the transceiver unit 12. The remote control unit 14 communicates with a second remote control unit 16 that for example is configured as a battery-free remote control unit 16. The remote control unit 16 includes a control unit 18, which, when activated, generates power for sending a signal 20 to the first remote control unit 14.

Figure 2:
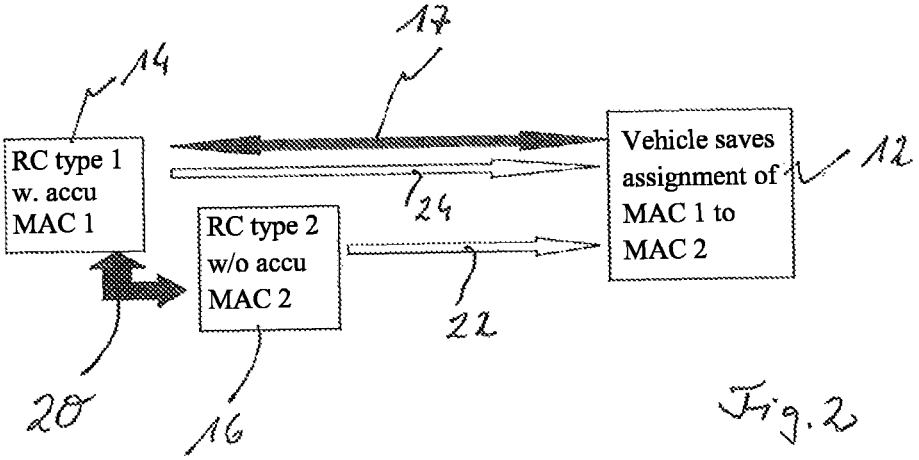
FIG. 2 illustrates a schematic diagram of an embodiment of the communication between the remote control units and the industrial truck.

The communication structure from FIG. 1 is portrayed in a schematic view in FIG. 2. The first remote control unit 14 is equipped for a bidirectional radio connection, for example by Bluetooth with the transceiver unit 12 of the industrial truck. The second remote control unit 16 that is not equipped with an energy store includes a unique address MAC 2 and communicates in a direct way 20 with the first remote control unit 14. In order to establish direct communication 20 between the first remote control unit 14 and the second remote control unit 16, a link to the remote control units 14, 16 is initiated in the transceiver unit 12 by means of near field communication 24, 22. For a first linking process, the first remote control unit 14 is brought close to the transceiver unit 12. In so doing, the transceiver unit 12 receives the unique address (MAC 1) from the first remote control unit 14, and this address (MAC 1) is used to establish a Bluetooth radio connection 17.

The transceiver unit 12 is configured as a transceiver unit of an industrial truck for a 1:1 connection. So that signals can also be sent to the transceiver unit via the second remote control unit 16 in addition to the first remote control unit 14, the second remote control unit 16 is linked to the first remote control unit 14, and not directly to the transceiver unit. For this, the second remote control unit 16 is connected by near field communication 22 to the transceiver unit 12. The unique address of the second remote control unit 16 is saved in the transceiver unit 12. The transceiver unit 12 sends the unique address (MAC 2) of the second remote control unit 16 to the first remote control unit 14 so that it can initiate a linking process between the first and the second remote control unit. Once the first and the second remote control units 14, 16 are linked, signals from the second remote control unit 16 can be forwarded via the first remote control unit 14 to the transceiver unit 12.

The second remote control unit 16 can be configured as a unit that is attachable to the hand or the fingers and can also be operated by fingers from the same hand One embodiment provides for example that the second remote control unit 16 is worn on the index and middle finger like a ring and operated by being pressed by the thumb.

This method generates particular advantages with a construction where the first remote control unit 14 is configured with an accumulator, and the second remote control unit 16 is configured without an energy source. The first remote control unit 14 assumes wireless communication with the transceiver unit 12 of the vehicle, for example in the form of radio commands or regular radio signals, so-called heartbeats. The second remote control unit 16 serves to transmit operator commands to the first remote control unit 14 so that it can then send the commands to the vehicle. The second remote control unit 16 is connected to the first remote control unit 14 by one of the following radio techniques such as zigbee, Bluetooth, 868 MHz for Europe, 902 MHz for the USA/Canada or 928 MHz for Japan. The second remote control unit 16 cannot directly send radio commands to the vehicle since it is only designed for a 1:1 connection to a remote control unit. The second remote control unit 16 possesses an NFC module for exchanging the unique address (MAC 2) with the transceiver unit 12.

This is achieved in that the vehicle only accepts operator commands from the second remote control unit 16 that is assigned to the vehicle by previously being paired to the first remote control unit 14. If the second battery-free remote control unit 16 is in a temporarily powerless state, the assignment must also be ensured after power is restored.

REFERENCE NUMBER LIST

10 Industrial truck
12 Transceiver unit
14 First remote control unit
16 Second remote control unit
17 Radio connection
18 Control element
20 Signal
22 Near field communication
24 Near field communication

The invention claimed is:

1. A method for linking a second remote control unit of an industrial truck to a first remote control unit of the industrial truck comprising:

linking the first remote control unit to a transceiver unit using a bidirectional radio connection;

transmitting a unique address of the second remote control unit to the transceiver unit by near field communication;

transmitting the unique address of the second remote control unit by the transceiver unit to the first remote control unit via the bidirectional radio connection;

linking the first remote control unit to the second remote control unit using the unique address of the second remote control unit; and transmitting a command from the second remote control unit to the first remote control unit, wherein the first remote control unit transmits the command by radio to the transceiver unit.

2. The method according to claim 1, wherein the first remote control unit comprises one of a battery and an accumulator.

3. The method according to claim 2, wherein the second remote control unit comprises a control element configured to generate power for transmitting the command when actuated.

4. The method according to claim 1, wherein the first and second remote control units each comprise a module for near field communication with the transceiver unit.

5. The method according to claim 1, wherein the first remote control unit is linked to the transceiver unit by near field communication, and wherein the first remote control unit is configured to send a unique address to the transceiver unit.

6. The method according to claim 5, wherein the transceiver unit assigns unique addresses to the first and second remote control units.

7. The method according to claim 1, wherein the first remote control unit is configured to disconnect the link to the second remote control unit when the first remote control unit does not have a radio contact with the transceiver unit for a predetermined duration of time.

8. The method according to claim 1, wherein the first remote control unit is configured to disconnect the link to the second remote control unit when the transceiver has been turned off.

9. The method according to claim 1, wherein the first remote control unit communicates by long-distance radio with the transceiver unit.

* * * * *